US007255771B2

(12) United States Patent
Chen et al.

(10) Patent No.: US 7,255,771 B2
(45) Date of Patent: Aug. 14, 2007

(54) MULTIPLE ZONE CARRIER HEAD WITH FLEXIBLE MEMBRANE

(75) Inventors: Hung Chih Chen, Santa Clara, CA (US); Jeonghoon Oh, Sunnyvale, CA (US); Tsz-Sin Siu, Santa Clara, CA (US); Thomas Brezoczky, San Jose, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 329 days.

(21) Appl. No.: 10/810,784

(22) Filed: Mar. 26, 2004

(65) Prior Publication Data

US 2005/0211377 A1 Sep. 29, 2005

(51) Int. Cl.
*B24B 29/00* (2006.01)

(52) U.S. Cl. ..... 156/345.12; 451/288; 451/398

(58) Field of Classification Search ..... 156/345.14, 156/345.15

See application file for complete search history.

(56) References Cited

U.S. PATENT DOCUMENTS

| | | | |
|---|---|---|---|
| 4,373,991 | A | 2/1983 | Banks |
| 4,918,869 | A | 4/1990 | Kitta |
| 5,081,795 | A | 1/1992 | Tanaka et al. |
| 5,193,316 | A | 3/1993 | Olmstead |
| 5,205,082 | A | 4/1993 | Shendon et al. |
| 5,230,184 | A | 7/1993 | Bukhman |
| 5,423,558 | A | 6/1995 | Koeth et al. |
| 5,423,716 | A | 6/1995 | Strasbaugh |
| 5,441,444 | A | 8/1995 | Nakajima |
| 5,443,416 | A | 8/1995 | Volodarsky et al. |
| 5,449,316 | A | 9/1995 | Strasbaugh |
| 5,476,414 | A | 12/1995 | Hirose et al. |
| 5,498,199 | A | 3/1996 | Karlsrud et al. |
| 5,584,751 | A | 12/1996 | Kobayashi et al. |
| 5,624,299 | A | 4/1997 | Shendon |
| 5,643,053 | A | 7/1997 | Shendon |
| 5,643,061 | A | 7/1997 | Jackson et al. |
| 5,738,574 | A | 4/1998 | Tolles et al. |
| 5,759,918 | A | 6/1998 | Hoshizaki et al. |
| 5,762,539 | A | 6/1998 | Nakashiba et al. |
| 5,762,544 | A | 6/1998 | Zuniga et al. |
| 5,803,799 | A | 9/1998 | Volodarsky et al. |
| 5,851,136 | A | 12/1998 | Lee |
| 5,851,140 | A | 12/1998 | Barns et al. |
| 5,879,220 | A | 3/1999 | Hasegawa et al. |

(Continued)

FOREIGN PATENT DOCUMENTS

| | | |
|---|---|---|
| DE | 86 31 087.9 | 4/1987 |

(Continued)

*Primary Examiner*—Sylvia MacArthur
(74) *Attorney, Agent, or Firm*—Fish & Richardson

(57) ABSTRACT

A carrier head for chemical mechanical polishing of a substrate includes a base and a flexible membrane extending beneath the base. The flexible membrane includes a central portion with an outer surface providing a substrate receiving surface, a perimeter portion connecting the central portion to the base, and at least one flap extending from an inner surface of the central portion. The flap divides a volume between the flexible membrane and the base into a plurality of chambers, and the flap includes a laterally extending first section and an angled second section extending beneath the first section and connecting the laterally extending first section to the central portion.

25 Claims, 2 Drawing Sheets

U.S. PATENT DOCUMENTS

| | | | | |
|---|---|---|---|---|
| 5,957,751 | A | 9/1999 | Govzman et al. | |
| 5,964,653 | A * | 10/1999 | Perlov et al. | 451/288 |
| 6,056,632 | A | 5/2000 | Mitchell et al. | |
| 6,080,050 | A | 6/2000 | Chen et al. | |
| 6,110,026 | A | 8/2000 | Arai | |
| 6,116,992 | A | 9/2000 | Prince | |
| 6,157,078 | A | 12/2000 | Lansford | |
| 6,159,079 | A | 12/2000 | Zuniga et al. | |
| 6,162,116 | A | 12/2000 | Zuniga et al. | |
| 6,165,058 | A * | 12/2000 | Zuniga et al. | 451/287 |
| 6,241,593 | B1 | 6/2001 | Chen et al. | |
| 6,291,253 | B1 | 9/2001 | Lansford et al. | |
| 6,406,361 | B1 * | 6/2002 | Zuniga et al. | 451/287 |
| 6,422,927 | B1 * | 7/2002 | Zuniga | 451/288 |
| 6,450,868 | B1 * | 9/2002 | Zuniga et al. | 451/388 |
| 6,612,903 | B2 | 9/2003 | Korovin et al. | |
| 6,722,965 | B2 * | 4/2004 | Zuniga et al. | 451/288 |
| 6,776,694 | B2 * | 8/2004 | Zuniga et al. | 451/41 |
| 6,857,945 | B1 * | 2/2005 | Chen et al. | 451/288 |
| 6,872,130 | B1 * | 3/2005 | Zuniga | 451/287 |
| 6,923,714 | B1 * | 8/2005 | Zuniga et al. | 451/289 |
| 7,001,257 | B2 * | 2/2006 | Chen et al. | 451/288 |
| 2002/0177395 | A1 * | 11/2002 | Han et al. | 451/398 |
| 2003/0171076 | A1 | 9/2003 | Moloney et al. | |
| 2004/0005842 | A1 * | 1/2004 | Chen et al. | 451/41 |
| 2004/0175951 | A1 * | 9/2004 | Chen | 438/692 |
| 2004/0192173 | A1 * | 9/2004 | Zuniga et al. | 451/41 |
| 2005/0142993 | A1 * | 6/2005 | Chen et al. | 451/287 |
| 2006/0025058 | A1 * | 2/2006 | Tseng et al. | 451/288 |

FOREIGN PATENT DOCUMENTS

| | | |
|---|---|---|
| EP | 0 156 746 A1 | 10/1985 |
| EP | 0 653 270 A1 | 5/1995 |
| EP | 0 841 123 A1 | 5/1998 |
| JP | 61-25768 | 2/1986 |
| JP | 63-114870 | 5/1988 |
| JP | 63-300858 | 12/1988 |
| JP | 1-216768 | 8/1989 |
| JP | 2-224263 | 9/1990 |
| JP | 2-243263 | 9/1990 |
| JP | 05 277929 | 10/1993 |
| WO | WO 96/36459 | 11/1996 |
| WO | WO 99/02304 A | 1/1999 |
| WO | WO 99/07516 | 2/1999 |
| WO | WO 99/33613 A | 7/1999 |
| WO | WO/00/13851 | 3/2000 |
| WO | WO 01/74534 A2 | 10/2001 |

* cited by examiner

MULTIPLE ZONE CARRIER HEAD WITH FLEXIBLE MEMBRANE

BACKGROUND

The present invention relates to a chemical mechanical polishing carrier head that includes a flexible membrane, and associated methods.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the exposed surface of the substrate becomes increasingly nonplanar. This nonplanar surface presents problems in the photolithographic steps of the integrated circuit fabrication process. Therefore, there is a need to periodically planarize the substrate surface.

One accepted method of planarization is chemical mechanical polishing (CMP). This planarization method typically requires that the substrate be mounted on a carrier or polishing head. The exposed surface of the substrate is placed against a moving polishing surface, such as a rotating polishing pad. The polishing pad may be a "standard" polishing pad with a durable roughened surface or a "fixed-abrasive" polishing pad with abrasive particles held in a containment media. The carrier head provides a controllable load to the substrate to push it against the polishing pad. A polishing slurry, which may include abrasive particles, is supplied to the surface of the polishing pad.

Some carrier heads include a flexible membrane with a mounting surface that receives the substrate. A chamber behind the flexible membrane is pressurized to cause the membrane to expand outwardly and apply the load to the substrate. Many carrier heads also include a retaining ring that surrounds the substrate, e.g., to hold the substrate in the carrier head beneath the flexible membrane. Some carrier heads include multiple chambers to provide different pressures to different region of the substrate.

SUMMARY

In one aspect, the invention is directed to a carrier head for chemical mechanical polishing of a substrate that includes a base and a flexible membrane extending beneath the base. The flexible membrane includes a central portion with an outer surface providing a substrate receiving surface, a perimeter portion connecting the central portion to the base, and at least one flap extending from an inner surface of the central portion. The flap divides a volume between the flexible membrane and the base into a plurality of chambers, and the flap includes a laterally extending first section and an angled second section extending beneath the first section and connecting the laterally extending first section to the central portion.

Implementations of the invention may include one or more of the following features. The first section may extend substantially horizontally. The second section may have a horizontal loading area sized so as to react out a portion of the downward force on the first section that is created by a pressure in a chamber between the flexible membrane and the base but is not reacted out by the base. The second section may have a horizontal loading area about one-half that of the first section. A point of attachment of the second section of the flap to the central portion may be substantially vertically aligned with a midpoint of the first section between a point of attachment of the first section to the base and a point of attachment of the first section to the second section. The perimeter portion may be directly connected to the base. A retaining ring may surround a substrate on the substrate receiving surface. The first section may be sufficiently vertically movable so that a pressure profile applied to a substrate is substantially in sensitive to retaining ring wear. The flexible membrane may include a plurality of flaps, each flap including a laterally extending first section and an angled second section extending beneath the first section. The flaps may be arranged annularly and concentrically, and the flaps may be configured to provide three independently pressurizable chambers. The first section and the second section have about the same rigidity, or the second section may be more rigid than the second section. The first section and the second section have about the same thickness, or the second section may be thicker than the first section. The flap may includes a vertical third section between the laterally extending first section and the angled second section and/or a vertical fourth section between the angled second section and the central portion. An angle $\alpha$ between the laterally extending first section and the angled second section may be between 20° and 80°, e.g., about 45°. The plurality of chambers may provide independently adjustable pressures to an associated plurality of regions of the substrate receiving surface, and the flexible membrane may be configured to provide a substantially uniform transition between different pressures in adjacent regions.

In another aspect, the invention is directed to a carrier head for chemical mechanical polishing of a substrate. The carrier head includes a base and a flexible membrane extending beneath the base to provide a substrate receiving surface and define a plurality of chambers to provide independently adjustable pressures to an associated plurality of regions of the substrate receiving surface. The flexible membrane is configured to provide a substantially uniform transition between different pressures in adjacent regions.

Implementations of the invention may include one or more of the following features.

The flexible membrane may be configured to provide a substantially monotonic transition between different pressures in adjacent regions. The flexible membrane may include a central portion with an outer surface providing the substrate receiving surface, a perimeter portion connecting the central portion to the base, and at least one flap extending from an inner surface of the central portion. The flap may divide a volume between the flexible membrane and the base into the plurality of chambers. The flap may include a laterally extending first section and angled second section extending beneath the first section and connecting the laterally extending first section to the central portion. The second section may have a horizontal loading area sized so as to react out a portion of the downward force on the first section that is created by a pressure in one of the plurality of chambers but is not reacted out by the base. The second section may have a horizontal loading area about one-half that of the first section. A point of attachment of the second section of the flap to the central portion may be substantially vertically aligned with a midpoint of the first section between a point of attachment of the first section to the base and a point of attachment of the first section to the second section.

In another aspect, the invention is directed to a flexible membrane for use with a carrier head of a substrate chemical mechanical polishing apparatus. The membrane has a central portion with an outer surface providing a substrate receiving surface, a perimeter portion for connecting the central portion to a base of the carrier head, and at least one flap extending from an inner surface of the central portion. The flap includes a laterally extending first section and an angled second extending beneath the first section.

In another aspect, the invention is directed to a method of polishing a substrate. The method includes mounting a substrate on a carrier head of a chemical mechanical polishing apparatus so that a first side the substrate is adjacent to the carrier head, polishing the substrate using a polishing pad contacting a second side of the substrate on a side opposite from the first side of the substrate; and applying different pressures to a plurality of chambers to create regions of different pressure the substrate. The carrier head includes a base portion, a retaining ring and a flexible membrane to provide a mounting surface for the substrate and define the plurality of chambers. The flexible membrane is configured to provide a substantially uniform transition between different pressures in adjacent regions.

In another aspect, the invention is directed to a method of operation of a flap of a flexible membrane. The flap is connected between a carrier head and a central portion of the flexible membrane that provides a substrate receiving surface. The method comprises creating a pressure differential between chambers on different sides of the flap, permitting a horizontal section of the flap to undergo vertical deflection, and reacting out a vertical component of forces on the flap caused by the pressure differential.

The invention can be implemented to realize one or more, or none, of the following advantages. In general, the flexible membrane may be configured to provide a more uniform transition (e.g., monotonically increasing or decreasing) between different pressures at the boundaries between adjacent pressurizable chambers or zones. In particular, the flexible membrane may be configured to reduce or eliminate pressure spikes at the locations where the flexible flaps which separate the chambers are joined to the central portion of the membrane which provides the substrate receiving surface. As a result, with appropriate selection of the pressures in the chambers to compensate for variations in the polishing rate and for variations in the incoming substrate layer thickness, a substrate polished using a carrier head with the flexible membrane of the present invention may have better planarity at the completion of the polishing process. In addition, the flexible membrane may be configured so that the pressure applied by the carrier head of a chemical mechanical polishing apparatus is less sensitive to retaining ring wear.

The details of one or more implementations of the invention are set forth in the accompanying drawings and the description below. Other features and advantages of the invention will become apparent from the description, the drawings, and the claims.

DESCRIPTION OF DRAWINGS

Like reference symbols in the various drawings indicate like elements.

DETAILED DESCRIPTION

As noted above, some carrier heads include a flexible membrane that provides a mounting surface for a substrate. In addition, some carrier heads include multiple chambers behind the flexible membrane. Each chamber can be independently pressurized to cause the membrane to expand outwardly and apply different loads to different zones of the substrate.

Unfortunately, in some membrane designs, the pressure distribution can be non-uniform at the transition between different zones. In particular, the configuration of the membrane may result in a pressure Spike at the boundary between the zones. This pressure spike can produce unintended non-uniformities in the polishing profile. Therefore, it would be useful to have a carrier head that had a more uniform pressure transition between adjacent independently pressurizable zones.

Figure 1:
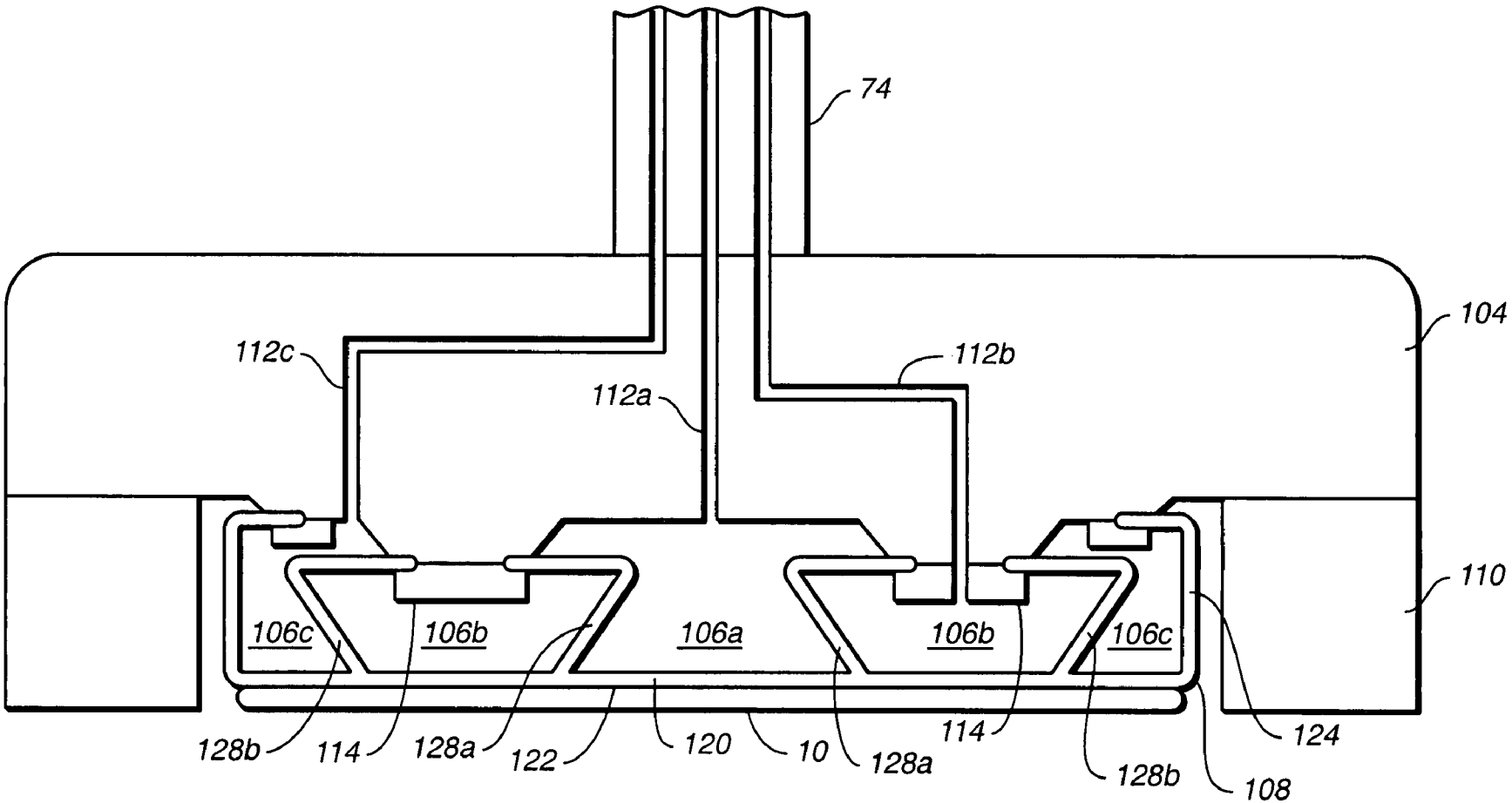
FIG. 1 is a cross-sectional view of a carrier head that includes a flexible membrane.

Referring to FIG. 1, one or more substrates 10 will be polished by a chemical mechanical polishing (CMP) apparatus that includes a carrier head 100. A description of a suitable CMP apparatus can be found in U.S. Pat. No. 5,738,574, the entire disclosure of which is incorporated herein by reference.

The carrier head 100 includes a base assembly 104 (which may be connected directly or indirectly to a rotable drive shaft 74), a retaining ring 110, and a flexible membrane 108. The flexible membrane 108 extends below and is connected to the base 104 to provide multiple pressurizable chambers, including a circular inner chamber 106*a*, a concentric annular middle chamber 106*b*, and a concentric annular outer chamber 106*c*. Passages 112*a*, 112*b* and 112*c* are formed through the base assembly 104 to fluidly couple the chambers 106*a*, 106*b*, 106*c*, respectively, to pressure regulators in the polishing apparatus. Although FIG. 1 illustrates three chambers, the carrier head could have two chambers or four or more chambers.

Although unillustrated, the carrier head can include other elements, such as a housing that is securable to the drive shaft and from which the base 104 is movably suspended, a gimbal mechanism (which may be considered part of the base assembly) that permits the base 104 to pivot, a loading chamber between the base 104 and the housing, one or more support structures inside the chambers 106*a*-106*c*, or one or more internal membranes that contact the inner surface of the membrane 108 to apply supplemental pressure to the substrate. For example, the carrier head 100 can be constructed as described in U.S. Pat. No. 6,183,354, or in U.S. patent application Ser. No. 09/470,820, filed Dec. 23, 1999, or in U.S. patent application Ser. No. 09/712,389, filed Nov. 13, 2000, the entire disclosures of which are incorporated by reference.

The flexible membrane 108 is formed of a flexible and elastic fluid-impermeable material, such as neoprene, chloroprene, ethylene propylene rubber or silicone. For example, the flexible membrane 108 can be formed of either compression molded silicone or liquid injection molded silicone.

The membrane 108 should be hydrophobic, durable, and chemically inert vis-à-vis the polishing process. The membrane 108 can include a central portion 120 with an outer surface that provides a mounting surface 122 for a substrate, an annular perimeter portion 124 that extends away from the polishing surface for connection to the base 104, and one or more concentric annular inner flaps 128*a*, 128*b* that extend from the inner surface 126 of the central portion 120 and are connected to the base 104 to divide the volume between the membrane 108 and the base 104 into the independently pressurizable chambers 106*a*-106*c*. The ends of the flaps 128*a*, 128*b* may be secured to the base 104 by an annular clamp ring 114 (which may be considered part of the base 104). The end of the perimeter portion 124 may also be secured to the base 104 by annular clamp ring 116 (which also may be considered part of the base 104), or the end of the perimeter portion may be clamped between the retaining ring and the base. Although FIG. 1 illustrates two flaps 128*a*, 128*b*, the carrier head could have just one flap, or three or more flaps.

The central portion 120 of the membrane 108 can include a flexible lip portion as discussed in U.S. Pat. No. 6,210,255, the entire disclosure of which is incorporated by reference.

Figure 2:
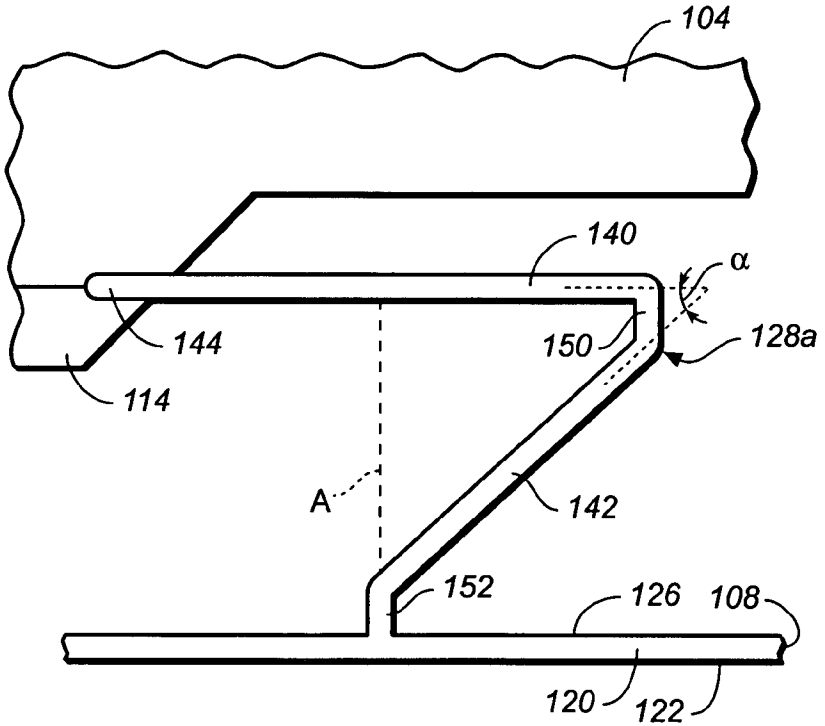
FIG. 2 is an expanded view of a portion of the carrier head of FIG. 1.

Referring to FIG. 2, each inner flap, such as the inner flap 128*a*, includes a generally horizontally extending upper portion 140 and an angled extension portion 142 joining the horizontal portion 140 to the central portion 120. The horizontal portion 140 has an end 144 that is secured to the base 104, e.g., clamped to the base 104 by the clamp 114. The angled portion 142 folds back beneath the horizontal portion 140, so that the angle $\alpha$ between the horizontal portion 140 and the angled portion 152 is acute rather than obtuse. The angle $\alpha$ may be between about 20° and 80°, e.g., about 45°. In particular, the membrane 108 may be configured so that the point where the angled portion 142 joins the inner surface 126 of the central portion 140 is generally vertically aligned (as shown by phantom line A) with a midpoint of the horizontal portion 140, e.g., halfway between the location where the horizontal portion is secured to the base 104 and the location where the horizontal portion is joined to the angled portion 142.

In general, the angled portion 142 can have a loading area sized so as to react out the portion of the downward force on the horizontal portion 140 that is created by the pressure in the chamber 106*a* but not reacted out by the base 104, as discussed in further detail below. Thus, the angled portion 142 may have about half of the loading area of the horizontal portion 140 (the loading area of the angled portion 142 can be determined by projecting the angled portion 142 onto a horizontal plane).

The flap may also include short vertical portions 150, 152 between the angled portion 142 and the horizontal portion 140 and/or the central portion 120, respectively.

The angled portion 142 and the horizontal portion 140 can have about the same thickness, and can be formed of the same material so that they have about the same rigidity.

Alternatively, the angled portion 142 can be formed to be more rigid than the horizontal portion 140. The angled portion can be thicker, e.g., by 50-100%, than the horizontal portion. For example, the horizontal portion can have a thickness of 20 mil, and the angled portion can have a thickness of 30-40 mil. In addition or alternatively, the angled portion can be formed of a different material than the horizontal portion, or include embedded elements, or be attached to a backing layer, so as to increase the rigidity of the angled portion. In general, in this implementation, the primary vertically deflection can be performed by bending of the horizontal portion 140, and the angled portion 152 can act as a spacer to separate the central portion 120 from and the base 104.

Figure 3:
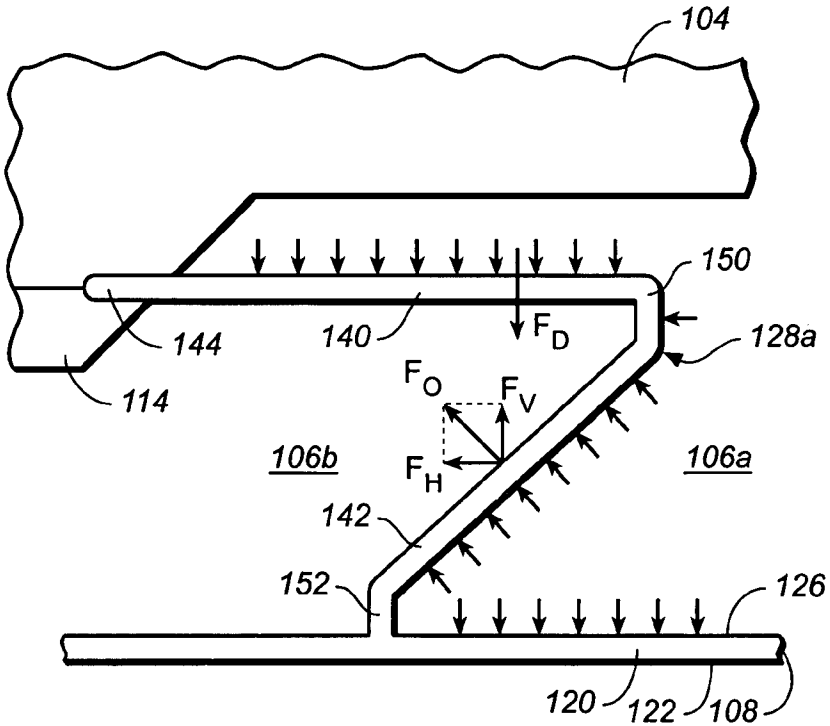
FIG. 3 is a schematic view illustrating forces applied to the flexible membrane.

Referring to FIG. 3, the pressure inside one chamber, e.g., the inner chamber 106*a*, applies both a downward force $F_D$ on the horizontal portion 140 and an outward force $F_O$ on the angled portion 142. The outward force $F_O$ can be decomposed into an upward force $F_U$ and a horizontal force $F_H$. Assuming that the loading area of the angled portion 142 is about half the loading area of the horizontal portion 140, the upward force $F_U$ can react out about half of the downward force $F_D$. In addition, about half of the downward force $F_D$ will be reacted out by the base itself, so that the net vertical force on the flap 128*a* is zero. As a result, the flap 128*a* will not push the central portion 120 downwardly or pull it upwardly, and thus the flap 128*a* should not introduce a pressure spike at the location where the flap is joined to the central portion. Consequently, the transition between adjacent zones (e.g., between the zones formed by chamber 106*a* and chamber 106*b*) should be more uniform, e.g., monotonically increasing or decreasing across the boundary between the zones.

As the retaining ring 110 wears, the attachment point of the flaps 128*a*-128*c* to the base 104 move closer to the polishing pad. However, the horizontal portion 140 be sufficiently compliant to accommodate retaining ring wear with substantially no changes in the pressure applied to the substrate.

The perimeter portion 124 can be less subject to deformation than other portions of the membrane. For example, the perimeter portion 124 can be relatively thicker than the central portion 120 or flap portions 128*a*, 128*b*. Alternatively, the perimeter portion 124 can be formed of a material that is more rigid than the material in other portions of the membrane, or it can include a reinforcing material, or it can extend around a support or spacing structure that prevents deformation. The perimeter portion may include a flexure, as described in U.S. patent application Ser. No. 10/409,637, filed Apr. 7,2003, the entire disclosure of which is incorporated herein by reference.

A number of embodiments of the invention have been described. Nevertheless, it will be understood that various modifications may be made without departing from the spirit and scope of the invention. For example, the membrane can be secured to different positions on the carrier head, such as being clamped between the retaining ring and the base, or being secured to the retaining ring itself. The horizontal portions of the flap can extend outwardly rather than inwardly. The membrane can be attached to one or more support structures that float or rest inside the chambers. The membrane can be formed as a unitary piece, or it can be formed from multiple membranes that are joined together, e.g., by an adhesive. In addition, the perimeter portion of the membrane can be indirectly connected to the base, e.g., the perimeter portion can be connected to a rigid support structure which is connected in turn to the base by, for example, a flexure. In addition, it should be understood, the membrane configuration may still be useful even if the particular shape does decrease sensitivity to retaining ring wear. For example, the carrier head could have a retaining that does not contact the polishing pad, or no retaining ring at all. In addition, the terms horizontal and vertical refer to the position of the membrane components relative to the substrate receiving surface, so the invention is still applicable if the carrier head is oriented with the polishing surface above the substrate or with a vertical polishing surface. Accordingly, other embodiments are within the scope of the following claims.

What is claimed is:

1. A carrier head for chemical mechanical polishing of a substrate, comprising:

a base; and a flexible membrane extending beneath the base, the flexible membrane including a central portion with an outer surface providing a substrate receiving surface, a perimeter portion connecting the central portion to the base, and at least one flap extending from an inner surface of the central portion, the flap dividing a volume between the flexible membrane and the base into a plurality of chambers, the flap including a laterally extending first section and an angled second section extending beneath the first section and connecting the laterally extending first section to the central portion, wherein an upper surface of the laterally extending first section and a lower surface of the angled second section bound a same chamber of the plurality of chambers.

2. The carrier head of claim 1, wherein the first section extends substantially horizontally.

3. The carrier head of claim 1, wherein the second section has a horizontal loading area sized so as to react out a portion of the downward force on the first section that is created by a pressure in a chamber between the flexible membrane and the base but is not reacted out by the base.

4. The carrier head of claim 1, wherein second section has a horizontal loading area about one-half that of the first section.

5. The carrier head of claim 1, wherein a point of attachment of the second section of the flap to the central portion is substantially vertically aligned with a midpoint of the first section between a point of attachment of the first section to the base and a point of attachment of the first section to the second section.

6. The carrier head of claim 1, wherein the perimeter portion is directly connected to the base.

7. The carrier head of claim 1, further comprising a retaining ring to surround a substrate on the substrate receiving surface.

8. The carrier head of claim 7, wherein the first section is sufficiently vertically movable so that a pressure profile applied to a substrate is substantially insensitive to retaining ring wear.

9. The carrier head of claim 1, wherein the flexible membrane includes a plurality of flaps, each flap including a laterally extending first section and an angled second section extending beneath the first section.

10. The carrier head of claim 9, wherein the flaps are arranged annularly and concentrically.

11. The carrier head of claim 10, wherein the flaps are configured to provide three independently pressurizable chambers.

12. The carrier head of claim 1, wherein the first section and the second section have about the same thickness.

13. The carrier head of claim 1, wherein the first section and the second section have about the same rigidity.

14. The carrier head of claim 1, wherein the second section is more rigid than the second section.

15. The carrier head of claim 14, wherein the second section is thicker than the first section.

16. The carrier head of claim 1, wherein the flap includes a vertical third section between the laterally extending first section and the angled second section.

17. The carrier head of claim 16, wherein the flap includes a vertical fourth section between the angled second section and the central portion.

18. The carrier head of claim 1, wherein the flap includes a vertical section between the angled second section and the central portion.

19. The carrier head of claim 1, wherein an angle I between the laterally extending first section and the angled second section is between 20° and 80°.

20. The carrier head of claim 19, where an angle I is about 45°.

21. The carrier head of claim 1, wherein the plurality of chambers provide independently adjustable pressures to an associated plurality of regions of the substrate receiving surface, and the flexible membrane is configured to provide a substantially uniform transition between different pressures in adjacent regions.

22. The carrier head of claim 1, wherein the flexible membrane is configured to undergo vertical deflection to react out force components caused by pressure differential between the chambers to provide a substantially uniform transition between different pressures in adjacent regions.

23. The carrier head of claim 22, wherein the flexible membrane configured to provide a substantially monotonic transition between different pressures in adjacent regions.

24. The carrier head of claim 1, wherein a point of attachment of the second of the flap to the central portion is substantially vertically aligned with a midpoint of the first section between a point of attachment of the first section to the base and a point of attachment of the first section to the second section.

25. A flexible membrane for use with a carrier head of a substrate chemical mechanical polishing apparatus, the membrane comprising:

a central portion with an outer surface providing a substrate receiving surface;

a perimeter portion for connecting the central portion to a base of the carrier head; and at least one flap extending from an inner surface of the central portion, the flap including a laterally extending first section and an angled second extending beneath the first section, wherein an upper surface of the laterally extending first section and a lower surface of the angled second section are configured to bound a same chamber of a plurality of chambers established upon attaching the flexible membrane to the carrier head.

* * * * *